United States Patent [19]

Byun

[11] 4,231,430

[45] Nov. 4, 1980

[54] AUTOMATIC SODA-ACID FIRE EXTINGUISHER SYSTEM

[76] Inventor: Dong J. Byun, 719-7, Chunghung-dong, Dong-Ku, Kwangju, Chunla Namdo, Rep. of Korea

[21] Appl. No.: 953,746

[22] Filed: Oct. 23, 1978

[51] Int. Cl.[3] ..... A62C 35/04

[52] U.S. Cl. ..... 169/57; 169/27; 169/61

[58] Field of Search ..... 169/7, 14, 27, 42, 57, 169/61, 79–82, 85, 87, 88; 222/54

[56] References Cited

U.S. PATENT DOCUMENTS

| | | | |
|---|---|---|---|
| 1,314,186 | 8/1919 | Dorstrom | 169/27 |
| 1,361,997 | 12/1920 | Holmes | 169/79 |
| 1,379,850 | 5/1921 | Canova, Jr. et al. | 169/27 |
| 1,936,007 | 11/1933 | Carroll | 169/27 |
| 2,689,613 | 9/1954 | Whatley | 169/27 |
| 3,613,795 | 10/1972 | Amicone et al. | 169/42 |

*Primary Examiner*—Robert J. Spar
*Assistant Examiner*—Fred A. Silverberg
*Attorney, Agent, or Firm*—Fleit & Jacobson

[57] ABSTRACT

A soda-acid fire extinguisher system reacts to the sensing of a fire in a building and starts a chemical reaction inside a sealed container. The chemical reaction produces carbon dioxide and water which is piped to the fire location and is sprayed on the fire by a nozzle. The fire extinguisher may also be manually activated and a nozzle is hand-held for extinguishing the fire.

1 Claim, 5 Drawing Figures

AUTOMATIC SODA-ACID FIRE EXTINGUISHER SYSTEM

BACKGROUND OF THE INVENTION

It is common that when a fire breaks out the occupants can put out the fire at the beginning. However, if a person does not use a fire extinguisher because he does not know how to operate the fire extinguisher, or if he does now know where the fire extinguisher is located, or if the person cannot approach the fire because the fire is hot, what started as a small-scale fire may quickly spread to a large-scale fire. Additionally, very often no one is around to operate whatever fire extinguisher may be available.

SUMMARY OF THE INVENTION

According to the present invention, a soda-acid fire extinguisher is located either in the interior or the exterior of the house and nozzles, that are connected to the fire extinguisher, are located in the interior of the room through the pipe lines so that, when a fire breaks out, and the fire is sensed by a fire detector, by the automatic initiation of a chemical reaction at the soda-acid fire extinguisher, the fire extinguisher supplies $H_2O$ and $CO_2$ gas to the nozzle. Accordingly, according to the present invention, it is obtainable not only easily to put out the fire, but also to keep the property damage to a minimum.

DETAILED DESCRIPTION OF THE PREFERRED EMBODIMENT

Figure 1:
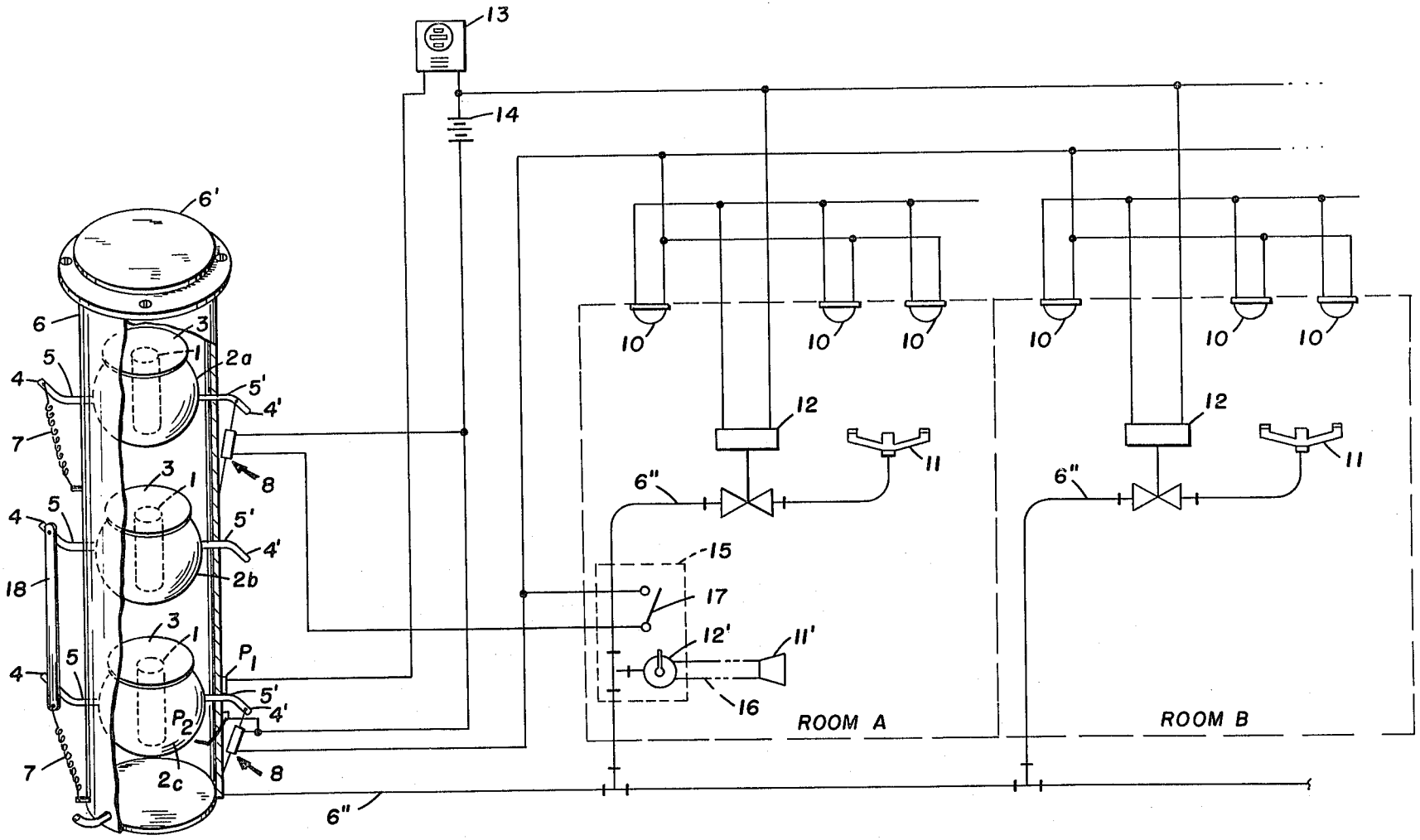
FIG. 1 is a combination pictorial and schematic diagram illustrating the system of the present invention.
Figure 5:
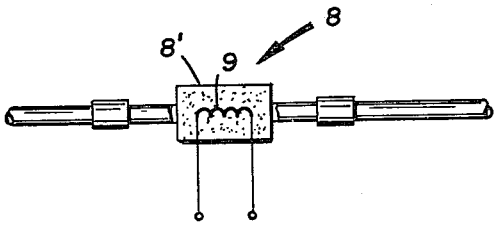
FIG. 5 is a perspective view, partially schematic of the vinyl string and filament used in the system of FIG. 1.

Even the operation of a fire extinguisher using soda-acid is well known and the conventional parts employed by the present invention are as shown in FIGS. 1 and 5. Namely, according to the present invention, each of the bottles 2 of soda solution has on its inner part a bottle 1 of sulfuric acid (or dilute sulfuric acid); and the opening of the bottle 2 is covered smoothly by a vinyl cover sheet 3 coated with petroleum jelly or the like. The bottle 2 is constructed to be turned downwardly on the support of the lever arms 4,4' formed integrally with the ends of the axles 5,5', respectively. The axles 5,5' and lever arms 4,4' are extended through the side wall of the chemical reaction chamber 6.

As seen in FIG. 1, several bottles 2*a*, 2*b* and 2*c* may be placed done by one into the inner part of the chemical reaction chamber 6; and the opening of this chamber 6 is shut by the cover 6'.

In order to bias the bottles 2*a*, 2*b*, and 2*c* in the upright position, there is a coil spring 7 on the free end of the lever arm 4; and this coil spring is connected between the outer side of the chamber 6 and the free end of the lever arm 4 of the bottle 2*a*. On the other side, the free end of the other lever arm 4' is also connected to the outside of the chamber 6 by a specially constructed vinyl string assembly 8. In this manner, each of the bottles 2*a*, 2*b* and 2*c* is fixed vertically, one by one, in the chamber 6.

Figure 2:
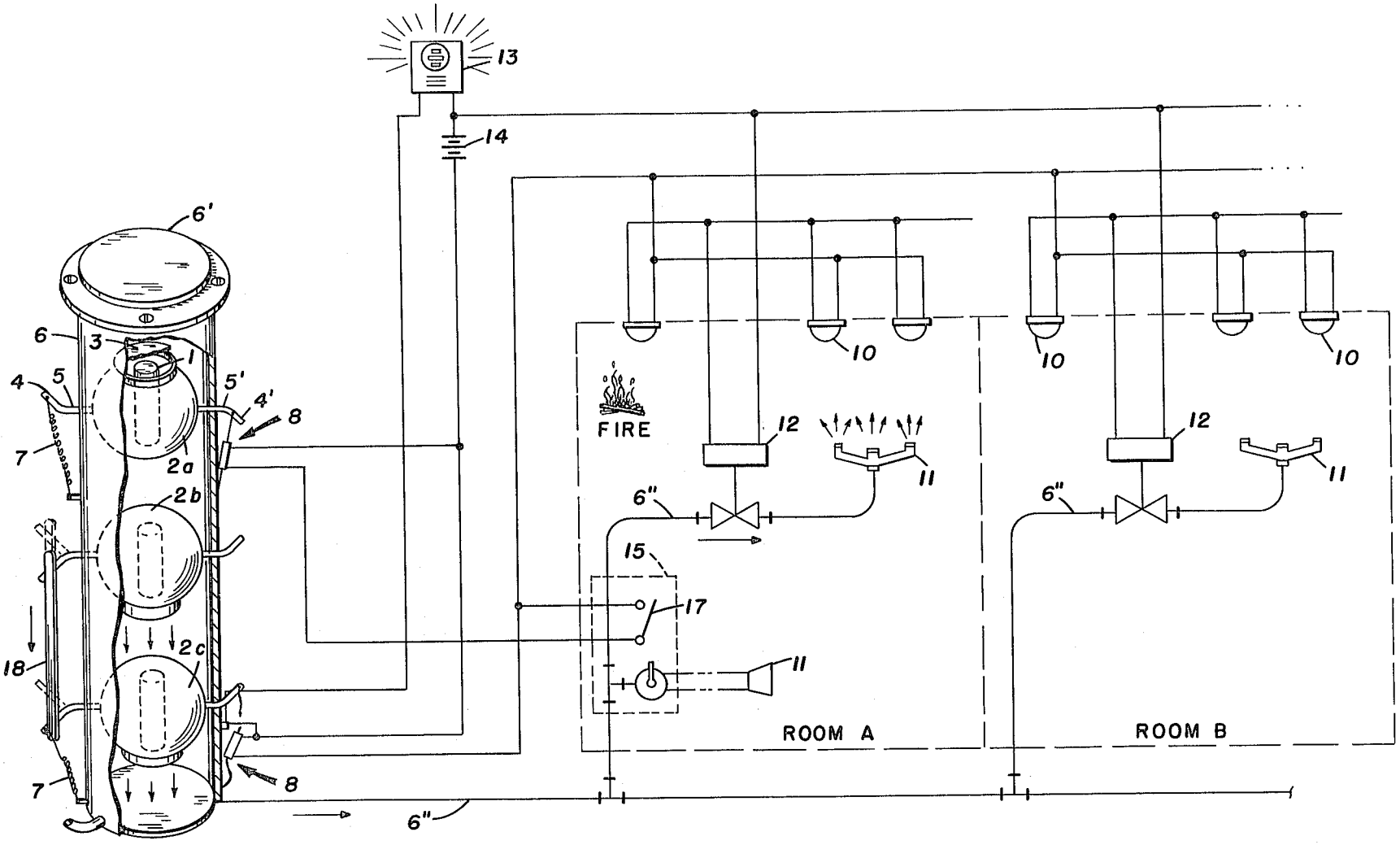
FIG. 2 illustrates the system of FIG. 1 wherein the fire-extinguisher has been operated.
Figure 3:
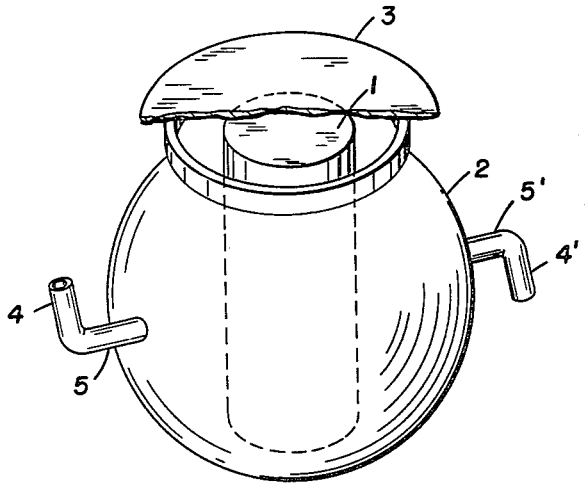
FIG. 3 is a perspective view of a typical bottle for use in the fire extinguisher of the present invention.

Referring to FIG. 5, on the central part of the vinyl string assembly 8, there is an inflammable or meltable element 8' made of a mixture of paraffin and sulfur in the ratio of 2:1; and the inner part of the element 8' has an electric filament 9 which is electrically connected to an electric battery, shown in FIGS. 1 and 2. The electric filament 9 is in series connection with the fire detector 10 and, if no fire is broken out, the filament 9 is not connected to the battery.

FIG. 1 shows a pipe 6'' connected to the chamber 6, and the pipe is distributed to each of the rooms A and B and the ends of the pipe have spray nozzles 11. However, because an electric-magnetic valve 12 is placed between the pipe and the nozzle, if the fire is not broken out, the valve 12 does not operate and the nozzles 11 are inactive.

Contacts $P_1$ and $P_2$ are placed between the bottle 2*c* and the axle 5'. So, when the bottle 2*c* is turned downwardly, the contacts $P_1$ and $P_2$ are touching each other, which completes the circuit with an audible alarm unit 13 and the battery 14. In this manner, the persons in the building can confirm not only that a fire has broken out, but also that the fire extinguisher system is operating normally.

A fire box 15 is also provided in the room and is equipped with a manual valve 12' and a manual nozzle 11' located on a flexible hose 16; and, as a person pushes the switch 17, the bottle 2*a* in the chamber 6 is turned downwardly. This occurs because the vinyl string assembly 8 is thereby electrically connected to the battery 14. Then, the mixing of soda and acid solutions in the bottle 6 causes the desired chemical reaction and the extinguishing gas and water produced are supplied to the nozzle 11'.

By means of a connecting rod 18, it is possible to cause simultaneously the operation of two bottles, 2*b* and 2*c*, of the fire extinguisher.

Figure 4:
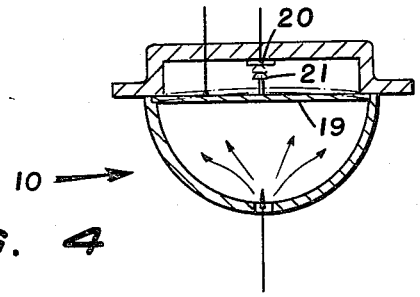
FIG. 4 is a cross-section side elevation of a fire detector used in the present invention.

The operation of the present invention will now be described in relation to FIGS. 1 and 2. If a fire breaks out in room A, the fire detector 10 in the room automatically gives the signal of fire. As illustrated in FIG. 4, the construction of the fire detector is such that after the passage of several seconds after a fire has broken out, the temperature within a room will rise about 10° C. Then, the air in the detector 10 is expanded and the diaphragm 19 is curved upwardly so that the contacts 20, 21 in the fire detector 10 are in contact with one another and the switching function is obtained. In such case, the magnetic valve 12 of the nozzle 11 in room A is opened; and, then, the inflammable element 8' linked to the vinyl string assembly 8 is burnt by the filament 9 and the string assembly 8 is severed. Then, by the elastic force of the coil spring 7 on the connecting rod 18, the lever arm 4 is pulled on, and the bottles 2*b* and 2*c* are turned downwardly. Then, the solutions of soda-acid in the bottles 2*b* and 2*c* are poured down on the bottom of the chamber 6 and, by the chemical reaction as follows, the $H_2O$ and $CO_2$ gas are produced.

$$2NaHCO_3+H_2SO_4 \rightarrow 2CO_2+2H_2O+Na_2SO_4$$

Due to the high pressure in the chamber 6, the extinguishing gas and water are supplied automatically to the nozzle 11 through the pipe lines 6' where the magnetic valve 12 is opened; and spread to the fire through the nozzle. However, because the magnetic valve in a room where the fire is not broken out is still closed, the extinguishing gas and water are not supplied.

When the bottle 2c is operated, the contact $P_1$ and $P_2$ are touched mutually and, then, the contact gives an audible and/or visible alarm at alarm 13 so that the persons can confirm that not only is a fire broken out, but also that the fire extinguisher is working normally.

When a small-scale fire breaks out, if a person pushes the switch 17 of the fire box 15 in the room, the string assembly 8 of bottle 2a is cut, as explained above, and the bottle is turned downwardly and the soda-acid solutions in the bottle are poured down onto the bottom of the chamber and the extinguishing gas and water are produced and are supplied automatically to the room A and, then, as the person opens the manual valve 12', the extinguishing gas and $H_2O$ are spreaded through the nozzle 11' so that the fire can be easily extinguished. After use, in order to prepare for the next use, the emptied bottle must be refilled with the soda-acid solutions.

Because the soda-acid fire extinguisher of the present invention can be easily used and automatically operated, as compared with the common water extinguishment, the present invention can provide an effective five extinguishing function with the attendant reduction of the damage to the furniture in the room. Even if there are only old people or children in the room, they can easily operate and extinguish the fire by the action as explained above. Thus, even if a fire breaks out, the fire can be easily extinguishable by anyone in the room, according to the present invention, and there is no need to call the fire station or, even if the fire engine has arrived on the site, the spread of the fire can be controlled.

It is understood, of course, that this description is given by way of example only and is not intended to limit the present invention, except as set forth in the appended claims.

What I claim is:

1. An automatic fire extinguishing system, comprising:

a cylindrical reaction chamber having several bottle assemblies located therein, said bottle assemblies comprising an external bottle and an internal bottle and each of the bottles containing chemicals and being supported inside the reaction chamber by at least one axle having lever arms extending from the opposite ends of the at least one axle, wherein the free end of one lever arm is connected to the outside of the chamber by a vinyl string having a selectively energizable electrical filament assembly, with the free end of the other lever arm being connected to the outside of the chamber by a coil spring, and means for energizing said electrical filament such that, when said filament is energized, the vinyl string is cut and the bottles are turned downwardly and the chemicals in the bottles are poured out on the bottom of the reaction chamber and the extinguishing gas and water produced by the reaction of the chemicals are conducted by supply means to a spray nozzle located proximate the fire.

* * * * *